United States Patent [19]

Sakamaki et al.

[11] 3,999,851

[45] Dec. 28, 1976

[54] ANTIJAMMING SAFETY DEVICE FOR COPYING MACHINE

[75] Inventors: Hisashi Sakamaki, Yokohama; Osamu Sawamura, Yamato; Katsushi Furuichi, Yokohama, all of Japan

[73] Assignee: Canon Kabushiki Kaisha, Tokyo, Japan

[22] Filed: Dec. 12, 1974

[21] Appl. No.: 532,000

[30] Foreign Application Priority Data

Dec. 21, 1973 Japan ..... 49-880[U]

[52] U.S. Cl. ..... 355/14; 271/259; 340/259

[51] Int. Cl.[2] ..... G03G 15/00

[58] Field of Search ..... 355/14, 3; 271/57, 230, 271/258, 259; 340/259

[56] References Cited

UNITED STATES PATENTS

| | | | |
|---|---|---|---|
| 3,655,283 | 4/1972 | Margulis et al. | 355/14 |
| 3,693,969 | 9/1972 | Sakamaki et al. | 355/14 X |
| 3,734,604 | 5/1973 | Szostak et al. | 340/259 X |
| 3,804,512 | 4/1974 | Komori et al. | 355/14 X |

*Primary Examiner*—L. T. Hix
*Assistant Examiner*—Kenneth C. Hutchison
*Attorney, Agent, or Firm*—Fitzpatrick, Cella, Harper & Scinto

[57] ABSTRACT

There is disclosed a safety device in a copying machine for detecting jamming of copying sheet materials to remove power only from the machine elements which might cause damage during subsequent operation of the machine. The copying machine is provided with a jam detector, a jam indicator to let a machine operator know of an occurrence of jamming, a disconnecting unit for operation in response to a signal from the jam detector to remove power from heaters, high voltage circuits, and other critical elements in the machine, and a jam indicator activating unit for operation in response to a signal from the disconnecting unit for activating the jam indicator after the lapse of a certain fixed period of time after receiving the signal.

10 Claims, 3 Drawing Figures

ANTIJAMMING SAFETY DEVICE FOR COPYING MACHINE

BACKGROUND OF THE INVENTION

1. Field of the Invention

This invention relates to an antijamming safety device adapted for use in a paper feeding mechanism in a copying machine, and particularly to a device for preventing troubles that might result from jamming of copying sheet materials after detecting such jamming. More specifically, the present invention is envisaged to provide an antijamming safety device of the type described, whereby when jamming of copying sheet materials is detected, only those means or elements which can bring about a dangerous condition unless they are promptly disconnected from power when said jamming occurs, such as for example heating means, are immediately disconnected from power. Then, after a delay period, jam indicating means are activated to let the operator know of such jamming, so that appropriate safety measures can be taken.

2. Description of the Prior Art

In copying machines or such, it is often experienced that the copying sheet materials such as sensitive paper, transfer paper, etc., may become held up in their passage through the machine (such phenomenon being hereinafter referred to as jamming). It is next to impossible with the existing techniques to perfectly exclude such jamming in copying machines. Therefore, efforts have been exerted for developing a method or a mechanism for detecting such jamming of sheets. In most systems, jamming of sheets is detected by a sensing device and the fixing heater or driving motor is immediately shut down by the output thereof, or a jam indicator lamp is lighted to let the operator know of such jamming, thereby to prevent trouble or breakdown that could result from such jamming.

However, if all the working means are shut down immediately after detection of jamming, a dangerous condition could rather be created. That is, in a copying machine, if delivery of certain copying sheets is slightly delayed after the specified setting, such delay can be sensed as jamming. In such a case, if an indication of jamming is given, the operator will immediately turn off the power switch, some copying sheets are still in the fixing unit. There is therefore a danger that such copying sheets may catch fire due to the thermal inertia of the heater in the fixing unit.

SUMMARY OF THE INVENTION

An object of the present invention is to provide an antijamming safety device for use in a paper feeding mechanism, whereby the above-said shortcomings of the prior art are eliminated and further safety is ensured.

Another object of the present invention is to provide an antijamming safety device for copying machines according to which when jamming of copying sheets is detected, only those units or elements which might compromise the safety of the machine unless they are promptly switched off, such as the heater, high-voltage source, etc., are immediately disconnected from power, and after the lapse of a certain time sufficient for slightly delayed sheets to move out of the machine, a jam indicator means is operated to let the operator know of such jamming and allow him to turn off the power switch without causing any consequent trouble.

Still another object of the present invention is to provide an antijamming safety device of the type described, according to which if each of the delayed sheet is discharged out within a certain fixed period of time after detection of jamming, there is no indication of jamming or interruption in the feeding of sheets, thus allowing immediate resumption of the copying operation.

DESCRIPTION OF THE PREFERRED EMBODIMENT

The present invention concerns a jam detecting safety device for a copying machine comprising means for detecting jamming of copying sheet materials, a jam indicator means, a first operating means controlled by said detector means for disconnecting power from the heating elements, high-voltage circuit and other such elements, and a second operating means for stopping the copying sheet delivery means etc., and for operating said indicator means after the lapse of a certain fixed period of time from actuation of said first means.

The invention is described below in detail by way of preferred embodiments thereof with reference to the accompanying drawings.

Figure 1:
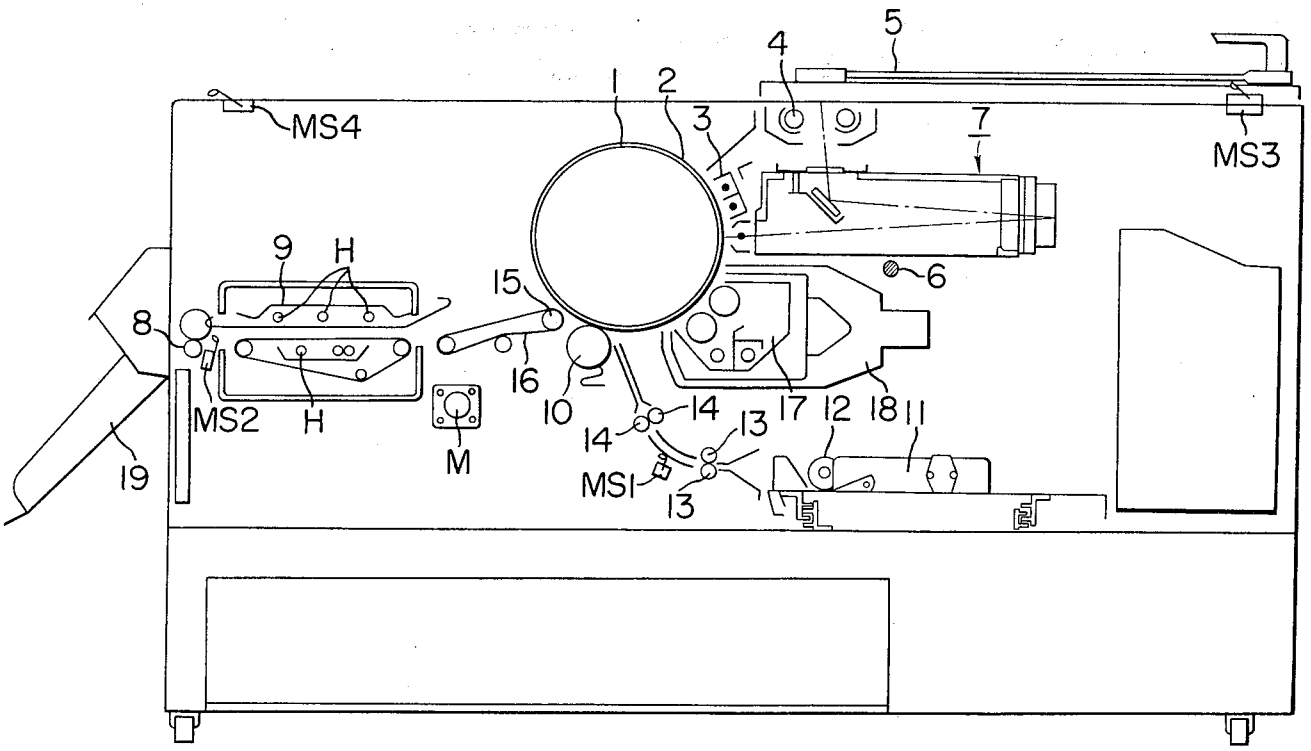
FIG. 1 is a diagrammatic plan view of a copying machine in which the present invention can be adapted.

FIG. 1 shows a diagrammatic plan view of a copying machine in which the present invention is adaptable. Each copying sheet supplied from a sheet feeding tray 11 by a feed roller 12 is guided through the copying process by delivery rollers 13, 14 and carrier belt means 15, 16, and after copying has been completed, each said sheet is passed through a fixing unit 9 provided with heating elements H and discharged out into a sheet discharge tray 19. As jamming of sheets could take place in this course from feed to discharge of sheets, an antijamming safety device including a jam detector means is provided at a suitable location in said course, needless to say, the present invention may be utilized not only in a transfer type copying machine as in this embodiment, but it can be applied also to the electrofax and other types of reproduction systems.

Figure 2:
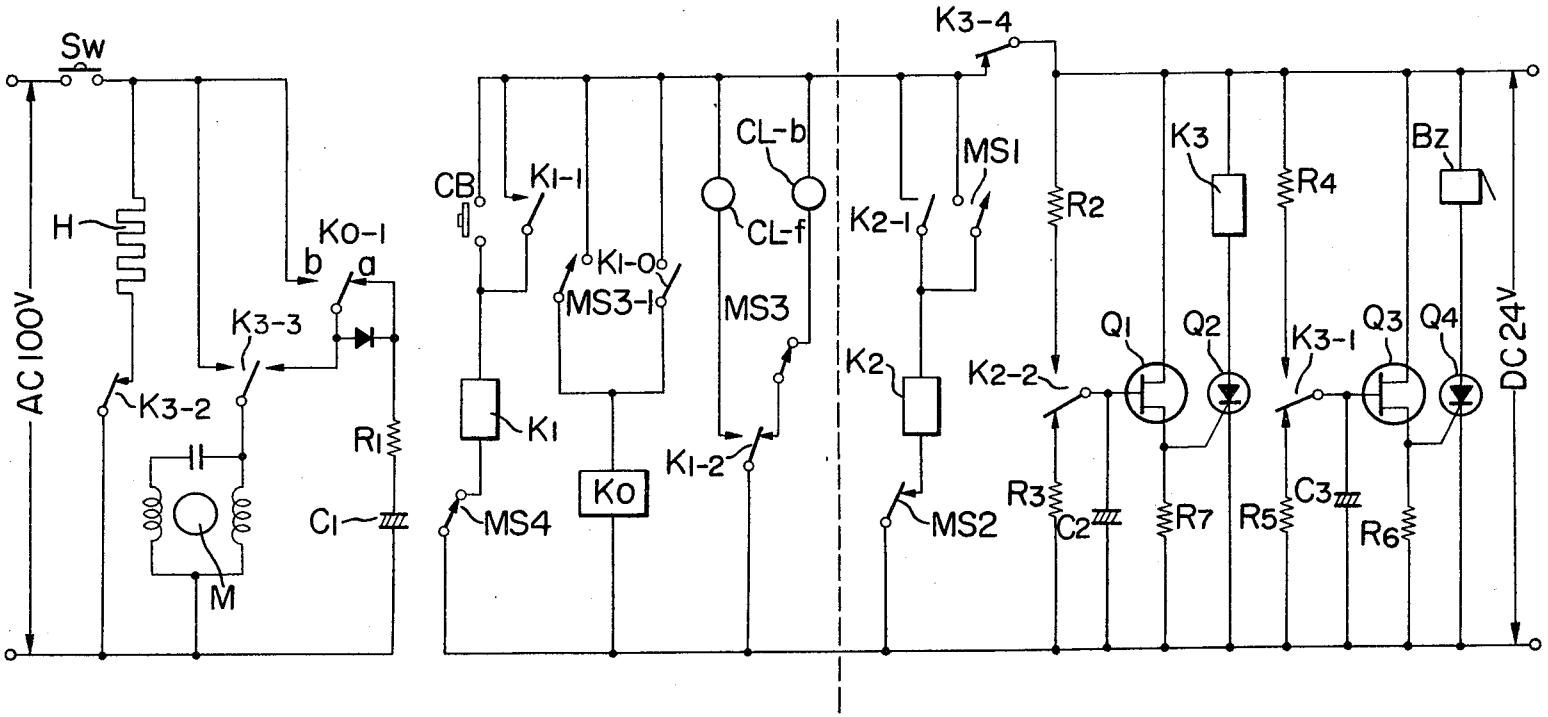
FIG. 2 is a circuit diagram showing an embodiment of the present invention.

FIG. 2 shows a circuit diagram of one embodiment of the present invention. In the operation of the system, first the power switch SW is turned on, whereby the heater H in the fixing unit is operated to heat the interior of the unit. Then, when the operator pushes the copy button CB for starting the copying operation, relay $K_1$ is energized and self-retained by contact $K_{1\text{-}1}$. At the same time, fluorescent lamps 4, 6 and a high voltage supply source (not shown) are connected to power and a voltage is applied to the electric charging means 2, 3. Then, electromagnetic clutch $CL_f$ is actuated by closure of contact $K_{1\text{-}2}$ of said relay $K_1$, followed by energization of relay $K_0$ with closure of contact $K_{1\text{-}0}$. The contact $K_{0\text{-}1}$ of said relay $K_0$ is connected to actuate the driving motor M to drive the original tray 5 through said electromagnetic clutch $CL_f$. The sensitive drum 1 and original tray 5 move at a speed ratio of 1 : 1, and the original image is projected through an optical system 7 to said drum surface to form a corresponding electrostatic latent image thereon. Such latent image is visualized by a developing means 12. In the meanwhile, the sheet feed roller 12 is rotated synchronously with cam means (not shown) on the drum 1 to feed the transfer sheets one by one. The image transferred to each transfer sheet is fixed by the fixing means 9, and then the sheet is discharged out of the machine. When the original tray 5 arrives at the microswitch MS4, relay $K_1$ is disconnected from power, so that the advancing clutch $CL_f$ is deenergized with disconnection of the contact $K_{1-2}$ while the reversing clutch $CL_b$ is energized to bring the original tray 5 into its return stroke. Upon arrival of the original tray 5 at the microswitch MS3 at the home position, clutch $CL_b$ is deenergized to stop movement of the tray 5, thereby completing one cycle of copying operation.

The antijamming safety device according to the present invention, as adapted in the above-said type of copying machine, is described in detail below. When the copying operation and feed of transfer sheets are started in the manner described above, microswitch MS1 is turned on to energize relay $K_2$, and its contact $K_{2-2}$ is connected to the resistance $R_2$ to charge capacitor $C_2$. Then the time interval $T_1$ of the timer consisting of the capacitor $C_2$, resistance $R_2$ and uni-junction transistor $Q_1$ is compared with the time interval $T_2$ that elapses from actuation of the microswitch MS1 with passage of each transfer sheet till the arrival of the sheet at the microswitch MS2 at the discharge port. That is, when microswitch MS1 is turned on and enabled relay $K_2$ is held through its contact $K_{2-1}$, the timer circuit consisting of the resistance $R_2$, capacitor $C_2$ and uni-junction transistor $Q_1$ begins to operate immediately. If capacitor $C_2$ is steadily charged, but the transfer sheet arrives at the microswitch MS2 before the charging of capacitor $C_2$ reaches the stand-off voltage of uni-junction transistor $Q_1$ (this is the normal feeding condition), microswitch MS2 is turned off to release relay $K_2$ and contact $K_{2-2}$ is connected to the resistance $R_3$ so that the capacitor $C_2$ discharges through resistance $R_3$. Under these conditions, the timer circuit does not produce an output. However, should the transfer sheets be jammed in their course of the copying process, or delayed for some reason or other, contact MS2 would be left closed so that uni-junction transistor $Q_1$ would be still connected to power to energize thyristor $Q_2$ and relay $K_3$ while simultaneously closing its contacts $K_{3-2}$, $K_{3-3}$ and $K_{3-4}$. When this occurs, heater H is disconnected from power but motor M continues its rotation to discharge the delayed transfer sheets while the electric current to resistance $R_2$ is shut off. As contact $K_{3-1}$ is connected to the resistance $R_4$, the delay timer circuit consisting of the resistance $R_4$ capacitor $C_3$, uni-junction transistor $Q_3$ and thyristor $Q_4$ is operated to energize a buzzer BZ or a warning lamp to indicating the occurence of jamming. Only at this time, the operator is informed of jamming and urged to turn off the power switch SW, thus accomplishing the antijamming safety function of the present device. In normal operation, an electric control circuit consisting of capacitor $C_1$, resistance $R_1$ and diode D is operated to stop the driving motor M upon every return of the original tray 5 to its home position.

There may be also provided a relay (not shown) energized by microswitch MS2, whereby when jamming is detected and relay $K_3$ is energized, but the transfer sheets are discharged before buzzer BZ is operated, the DC source is disconnected from power by the contact of said relay to interrupt operation of the delay timer circuit so that said buzzer BZ will not work. Consequently, thyristor $Q_2$ ceases its conduction and relay $K_3$ is disenergized, while capacitor $C_3$ is discharged through resistance $R_5$ and microswitch MS2 restores to its normal mode of operation after discharge of sheets, so that the normal copying operation can be immediately restarted.

Figure 3:
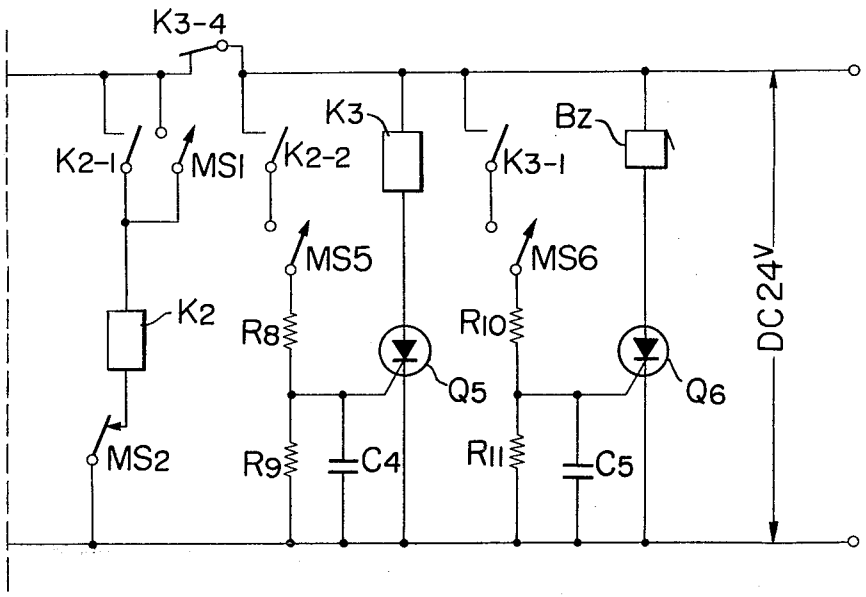
FIG. 3 is a circuit diagram showing another embodiment of the present invention.

Referring now to FIG. 3, there is shown a circuit arrangement exchangeable for the circuit portion on the right side of the dotted line in FIG. 2) according to another embodiment of the present invention, in which, instead of using the delay timer circuit in the previous embodiment, a delay signal is obtained from the sensitive drum and is used to detect jamming, so that an indication of jamming is given after the lapse of a certain fixed period of time from detection of jamming. This circuit arrangement includes switches MS5 and MS6 which are operated by a cam provided on the sensitive drum at a certain predetermined angle. Switch MS1 is turned on simultaneously with the start of synchronized movement of the copy sheet and the sensitive drum, and when the time required for the transfer sheets to be discharged elapses, switch MS5 is closed. During this time, if sheet discharge is normally practiced and switch MS2 remains open, relay $K_2$ is not energized and hence thyristor Q5 stays inoperative. However, if sheet discharge is delayed and switch MS2 stays closed, thyristor $Q_5$ and relay $K_3$ are energized, so that the jamming of sheets is detected and the heater and other critical elements are disconnected from power in the same way as described before. Contact $K_{3-1}$ is also closed, so that when switch MS6 is closed by a second cam after the lapse of a fixed period of time with further rotation of the sensitive drum, thyristor Q6 is energized to operate buzzer BZ. That is, buzzer BZ is operated by an "and" signal of the jam detection signal and second cam signal. Arrangement may be made such that microswitch MS1, for indicating the sheet feeding time, is turned on by the cam provided on the drum. The time span from detection of jamming to operation of the buzzer may be procured by racing after at least one rotation of the sensitive drum.

Although the sensitive drum is utilized in producing a working signal in the foregoing discussion of the invention, it is also possible to obtain a delay timer signal by using any other member which rotates during carriage of copying sheets, such as for example a transfer drum (which is usually used in color copying machines and arranged such that the image on the sensitive drum is transferred to the transfer sheet held on the transfer drum) with the aid of a cam or such means provided on the drum.

We claim:

1. An antijamming safety device for use in a copying machine having means for advancing a copying medium along a predetermined path, comprising:

means for detecting the occurrence of jamming of copying medium in the path, and for producing a jam detection signal in response thereto;

first control means coupled to said jam detecting means and operative in response to a said jam detection signal to disable selected machine elements excluding the copy medium advancing means;

means for indicating an alarm representative of the occurrence of jamming of copying medium; and second control means for actuating said alarm indicating means when a predetermined period of time has passed since operation of said first control means.

2. An antijamming safety device according to claim 1, further including means for disabling said second control means to prevent actuation of said alarm indicating means when a copying medium is discharged from the machine during said predetermined period of time.

3. An antijamming safety device according to claim 1, wherein said detecting means comprises first timing means for producing said jam detection signal when copying material is not discharged from the machine after a lapse of time required for the transfer of the copying medium over the predetermined path.

4. An antijamming safety device according to claim 3, wherein said second control means comprises second timing means for producing an output after a predetermined lapse of time measured from the occurrence of said jam detecting signal.

5. An antijamming safety device according to claim 1, wherein said machine includes a member which moves synchronously with the advancement of the copying medium, and wherein said second control means includes means for energizing said alarm indicating means in response to movement of said moving member over a predetermined distance after the occurrence of said detecting signal.

6. An antijamming safety device according to claim 5, wherein the moving member is a rotatable image carrying drum, and said indicating means is actuated when said drum has rotated through a predetermined angle.

7. An antijamming safety device for use in a copying machine having means for carrying a copying medium along a predetermined path, and having a moving member commencing to move synchronously with the carrying of copying medium by said carrying means, comprising:

means for detecting the occurrence of jamming of copying medium in the path, and for producing a jam detention signal;

first control means coupled to said jam detecting means and operative in response to a said jam detection signal to disable selected machine elements excluding said copying medium carrying means;

means for indicating an alarm representative of the occurrence of jamming of copying medium; and second control means for actuating said alarm indicating means when said moving member has moved over a predetermined distance since the occurrence of a said jam detecting signal.

8. An antijamming safety device according to claim 7, wherein said moving member is an image carrying drum, and wherein said alarm indicating means is actuated when said drum has rotated through a predetermined angle.

9. An antijamming safety device according to claim 7, wherein said jam detecting means comprises means for producing said jam detection signal when the moving member has moved over the predetermined distance in the absence of copying material being discharged from the machine.

10. An antijamming safety device according to claim 7, further comprising spaced first and second signal producing means disposed on the moving member, and means for sensing the presence of copying medium at the output end of the path, wherein said jam detection signal is produced in response to a combination of a signal from said first signal producing means and a signal from said sensing means, and wherein said alarm indicating means is actuated in response to a combination of said jam detection signal and a signal from said second signal producing means.

* * * * *

UNITED STATES PATENT AND TRADEMARK OFFICE

CERTIFICATE OF CORRECTION

PATENT NO. : 3,999,851
DATED : December 28, 1976

INVENTOR(S) : HISASHI SAKAMAKI, OSAMU SAWAMURA, KATSUSHI FURUICHI

It is certified that error appears in the above-identified patent and that said Letters Patent are hereby corrected as shown below:

Column 6, line 3, delete "detention" and insert --detection--.

Signed and Sealed this

Eighth Day of March 1977

[SEAL]

*Attest:*

RUTH C. MASON
*Attesting Officer*

C. MARSHALL DANN
*Commissioner of Patents and Trademarks*